US008666235B2

(12) United States Patent
Powell et al.

(10) Patent No.: US 8,666,235 B2
(45) **Date of Patent: *Mar. 4, 2014**

(54) LIQUID FUEL VAPORIZER AND COMBUSTION CHAMBER HAVING AN ADJUSTABLE THERMAL CONDUCTOR

(75) Inventors: Michael R. Powell, Kennewick, WA (US); Greg A. Whyatt, West Richland, WA (US); Daniel T. Howe, Pasco, WA (US); Matthew S. Fountain, Kennewick, WA (US)

(73) Assignee: Battelle Memorial Institute, Richland, WA (US)

( * ) Notice: Subject to any disclaimer, the term of this patent is extended or adjusted under 35 U.S.C. 154(b) by 543 days.

This patent is subject to a terminal disclaimer.

(21) Appl. No.: 12/945,305

(22) Filed: Nov. 12, 2010

(65) Prior Publication Data

US 2011/0059409 A1 Mar. 10, 2011

Related U.S. Application Data

(63) Continuation-in-part of application No. 11/674,975, filed on Feb. 14, 2007, now Pat. No. 7,899,309.

(51) Int. Cl.
*F23D 11/44* (2006.01)

(52) U.S. Cl.
USPC ..... 392/386; 392/399; 122/4 D

(58) Field of Classification Search
USPC ..... 392/399, 386, 307, 397; 122/30, 39, 122/4 D; 165/276, 86, 96
See application file for complete search history.

(56) References Cited

U.S. PATENT DOCUMENTS

| | | | | | |
|---|---|---|---|---|---|
| 3,566,615 | A * | 3/1971 | Roeder | 62/511 |
| 3,584,194 | A * | 6/1971 | Kautz et al. | 392/484 |
| 3,835,294 | A * | 9/1974 | Krohn et al. | 392/484 |
| 3,854,032 | A * | 12/1974 | Cooper | 219/383 |
| 3,890,086 | A * | 6/1975 | Miyahara | 431/168 |
| 4,055,220 | A * | 10/1977 | Stelwagen | 165/89 |
| 4,465,922 | A * | 8/1984 | Kolibas | 392/484 |
| 4,480,172 | A * | 10/1984 | Ciciliot et al. | 392/396 |
| 4,535,836 | A * | 8/1985 | Thomas et al. | 165/86 |
| 6,162,046 | A * | 12/2000 | Young et al. | 431/11 |
| 6,343,416 | B1 * | 2/2002 | Miller et al. | 29/890.035 |
| 6,461,148 | B1 * | 10/2002 | Scotto et al. | 431/215 |
| 7,297,324 | B2 * | 11/2007 | TeGrotenhuis et al. | 423/659 |
| 7,481,205 | B2 * | 1/2009 | Keeler et al. | 123/549 |
| 7,756,404 | B2 * | 7/2010 | Schubert et al. | 392/478 |
| 2004/0173345 | A1 * | 9/2004 | Belady et al. | 165/185 |
| 2008/0193112 | A1 * | 8/2008 | Whyatt et al. | 392/399 |
| 2012/0070134 | A1 * | 3/2012 | Durisek | 392/386 |

FOREIGN PATENT DOCUMENTS

WO 99/05452 A2 2/1999

* cited by examiner

*Primary Examiner* — Geoffrey S Evans
*Assistant Examiner* — John J Norton
(74) *Attorney, Agent, or Firm* — Allan C. Tuan

(57) ABSTRACT

The efficiency and effectiveness of apparatuses for vaporizing and combusting liquid fuel can be improved using thermal conductors. For example, an apparatus having a liquid fuel vaporizer and a combustion chamber can be characterized by a thermal conductor that conducts heat from the combustion chamber to the vaporizer. The thermal conductor can be a movable member positioned at an insertion depth within the combustion chamber that corresponds to a rate of heat conduction from the combustion chamber to the vaporizer. The rate of heat conduction can, therefore, be adjusted by positioning the movable member at a different insertion depth.

17 Claims, 7 Drawing Sheets

LIQUID FUEL VAPORIZER AND COMBUSTION CHAMBER HAVING AN ADJUSTABLE THERMAL CONDUCTOR

PRIORITY

This invention claims priority from, and is a continuation in part of, currently pending U.S. patent application Ser. No. 11/674,975, filed Feb. 14, 2007, which is incorporated herein by reference.

STATEMENT REGARDING FEDERALLY SPONSORED RESEARCH OR DEVELOPMENT

This invention was made with Government support under Contract DE-AC0576RLO1830 awarded by the U.S. Department of Energy. The Government has certain rights in the invention.

BACKGROUND

Liquid fuel combustors employing fuel vaporization, as opposed to liquid/aerosol injection, require a heat source for the vaporizer. In order to minimize the formation of deposits, to prevent the clogging of flow channels in the vaporizer, and/or to maximize the operational efficiency of the apparatus, the rate and amount of heating should be carefully controlled. Electrical heaters can provide controlled heating, but require a power supply, which reduces the efficiency of the apparatus. Flow channels that pass liquid fuel through the combustion chamber can efficiently utilize heat from the combustion chamber, but can be hard to control. Accordingly, a need exists for an efficient, well-controlled apparatus for vaporization and combustion of liquid fuels.

SUMMARY

The present invention is an apparatus for vaporizing and combusting liquid fuel. The apparatus comprises a liquid fuel vaporizer and a combustion chamber and is characterized by a thermal conductor that conducts heat from the combustion chamber to the vaporizer. The thermal conductor comprises a movable member positioned at an insertion depth within the combustion chamber that corresponds to a rate of heat conduction from the combustion chamber to the vaporizer. The rate of heat conduction can, therefore, be adjusted by positioning the movable member at a different insertion depth. Preferably, the movable member comprises a thermally conductive material such as copper. In some embodiments, an actuator can control the insertion depth of the movable member.

In one embodiment, a stationary member within the combustion chamber can form a longitudinal cavity inside of which the movable member is inserted. The thermal conductivity of the thermal conductor would be a composite value based on the insertion depth of the movable member, the movable member thermal conductivity, and the stationary member thermal conductivity.

In a particular example, the stationary member can support, at least in part, an impaction plate within the combustion chamber. The impaction plate, upon which a flame can impinge, can transfer heat through the thermal conductor to the vaporizer. In some configurations, the impaction plate can also transfer heat to the vaporizer by radiation. The stationary member can be arranged as one or more posts attached to the impaction plate and thermally contacting the vaporizer. The movable member can comprise a rod placed in one or more of the posts.

Preferably, the stationary member comprises a corrosion resistant material. Exemplary materials can include, but are not limited to nickel-chromium-based alloys (i.e., INCONEL alloys 600, 601, 625, HASTELLOY X, AND HAYNES 214). The thermal conductivity of the movable member is preferably greater than or substantially equal to that of the stationary member.

With certain liquid fuels, vaporization is especially difficult because the temperature for complete vaporization is similar to the temperature at which breakdown of the fuel can occur. Given the efficiency and controllability of embodiments of the present invention, the apparatuses described herein can be especially suitable for liquid fuels having a boiling range greater than or equal to that of JP-8, which has a specified boiling point of 300° C. In a particular embodiment, the operating temperature of the vaporizer is between 300° C. and 400° C.

While embodiments of the present invention are compatible with almost any vaporizer, in preferred embodiments, the liquid fuel vaporizer comprises a first body having a cross sectional shape and dimensions substantially equal to the cross sectional shape and dimensions of a cavity in a second body, which allows the first body to be non-permanently inserted into the second body. The outer surface of the first body, the inner surface forming the cavity in the second body, or both can be modified to create a vaporization pathway between the first and second bodies when the surfaces mate and/or align. The liquid vaporizer can further comprise a vaporization pathway inlet for fluid comprising liquid, a vaporization pathway outlet for fluid comprising primarily vapor. The thermal conductor can be in thermal communication with the first body, the second body, or both, and provides control of the temperature of the vaporization pathway.

As used herein, the non-permanent insertion of the first body into the second body refers to the ability to non-destructively insert and separate the first body relative to the second body. The capability to separate the first and second bodies can, for example, facilitate cleaning and/or maintenance of the vaporization pathway and any assemblies or structures that may not be accessible but for removing the first body from the second body. The joining of the two bodies can form a substantially non-leaking union. Any variety of mechanisms can be used to secure the first body in the second body as necessary. Examples of fastening mechanisms can include, but are not limited to, screw threads, fastening tabs, compression fittings, friction fittings, locking jaws, locking studs, etc.

Modifications to the outer surface of the first body and/or the inner surface forming the cavity in the second body can result in a vaporization pathway comprising a channel formed along the outer surface of the first body, along the inner surface forming the cavity of the second body, or both, such that when the two bodies and/or surfaces mate, fluid can flow through the channel. In some embodiments, the channel is curved to increase the vaporization pathway length, which, in many instances, can increase the amount of time and/or distance for heat transfer.

The purpose of the foregoing abstract is to enable the United States Patent and Trademark Office and the public generally, especially the scientists, engineers, and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

Various advantages and novel features of the present invention are described herein and will become further readily apparent to those skilled in this art from the following detailed description. In the preceding and following descriptions, the various embodiments, including the preferred embodiments, have been shown and described. Included herein is a description of the best mode contemplated for carrying out the invention. As will be realized, the invention is capable of modification in various respects without departing from the invention. Accordingly, the drawings and description of the preferred embodiments set forth hereafter are to be regarded as illustrative in nature, and not as restrictive.

DESCRIPTION OF DRAWINGS

Embodiments of the invention are described below with reference to the following accompanying drawings.

DETAILED DESCRIPTION

Figure 1A:
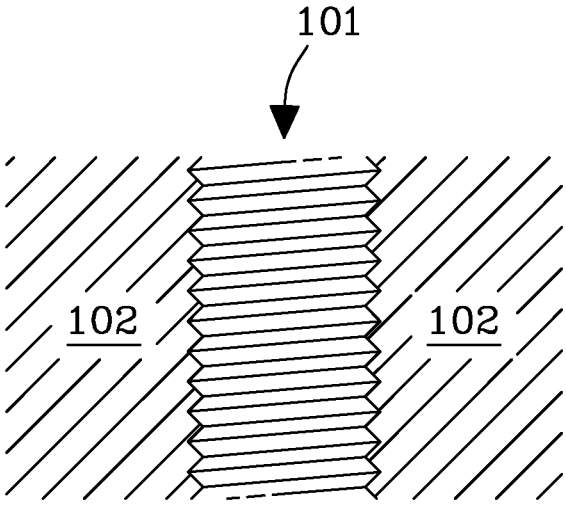
FIG. 1*a* is an illustration of the cross-section of an embodiment of a liquid vaporizer comprising threaded first and second bodies.
Figure 1B:
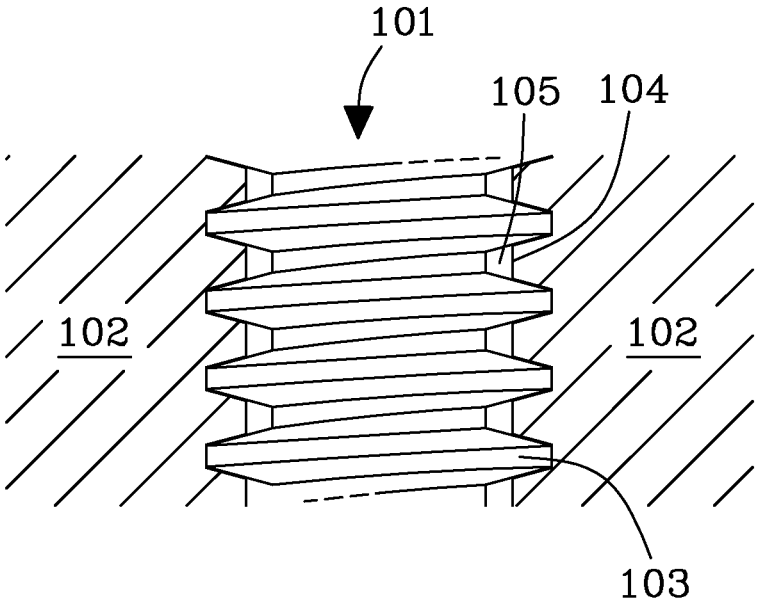
FIG. 1*b* is a detail view of the mated surfaces in one embodiment of a liquid vaporizer comprising threaded first and second bodies.
Figure 2:
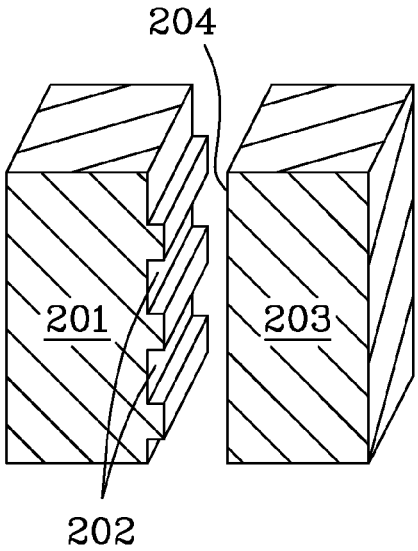
FIG. 2 is an illustration of the cross-section of an embodiment of a liquid vaporizer comprising non-threaded first and second bodies.
Figure 3:
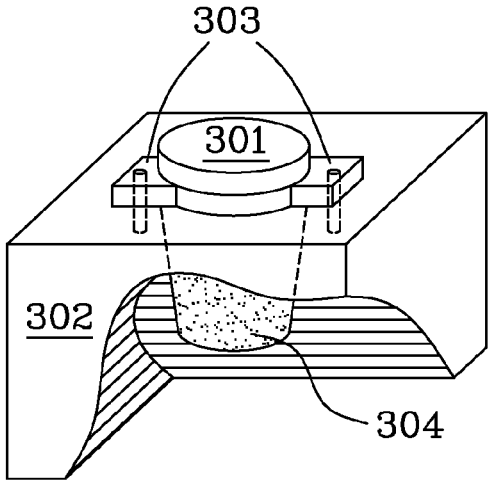
FIG. 3 is an illustration showing an embodiment of a liquid vaporizer comprising tapered first and second bodies having textured surfaces.
Figure 4:
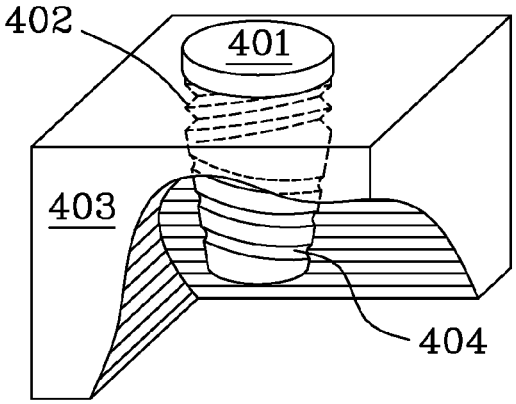
FIG. 4 is an illustration of an embodiment of a liquid vaporizer comprising tapered first and second bodies.
Figure 5:
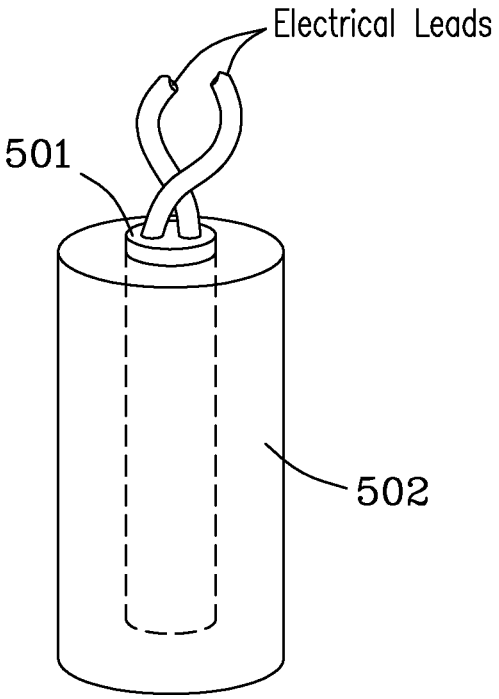
FIG. 5 is an illustration of an embodiment of a liquid vaporizer utilizing an electrical cartridge heater.
Figure 6:
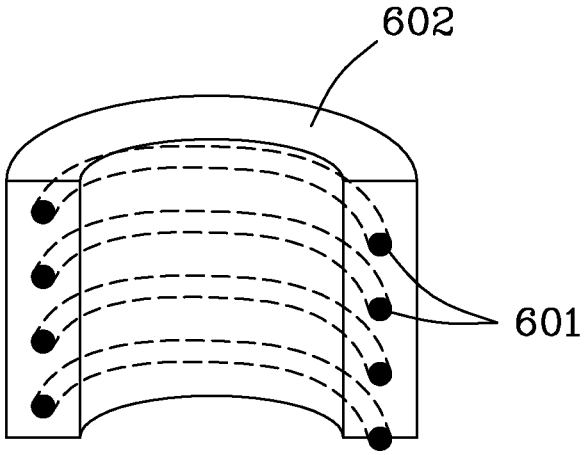
FIG. 6 is an illustration of the cross section of an embodiment of a liquid vaporizer utilizing a resistive element heater.

The following description includes the preferred best mode among other embodiments of the present invention. It will be clear from this description of the invention that the invention is not limited to these illustrated embodiments but that the invention also includes a variety of modifications and embodiments thereto. Therefore the present description should be seen as illustrative and not limiting. While the invention is susceptible of various modifications and alternative constructions, it should be understood, that there is no intention to limit the invention to the specific form disclosed, but, on the contrary, the invention is to cover all modifications, alternative constructions, and equivalents falling within the spirit and scope of the invention as defined in the claims.

FIGS. 1-10 show a variety of aspects and embodiments of the present invention. Referring first to FIGS. 1*a* and 1*b*, a particular liquid vaporizer is embodied by a first body 101 comprising a screw having screw threads 103. The inner surface forming the cavity in the second body 102 comprises cavity threads 104 corresponding to the screw threads. The vaporization pathway comprises a channel 105 formed from modifications to the screw threads, the cavity threads, or both. In the context of threads, exemplary modifications can include, but are not limited to, truncating, notching, and/or removing at least a portion of the ribs composing the screw threads, the ribs composing the cavity threads, or both. Accordingly, the first body 101 can be screwed into the second body 102 and the modified threads can provide a vaporization pathway for fluid flow. Referring to FIG. 1*b*, which is a detail view of the embodiment illustrated in FIG. 1*a*, the tips of the cavity threads 104 have been bored (i.e., truncated) to a larger inside diameter such that when the screw threads 103 are mated, a channel 105 is formed between the bored cavity threads 104 and the screw threads 103.

In alternative embodiments, the vaporization pathway can comprise one or more channels formed in the outer surface of the first body, the inner surface forming the cavity in the second body, or both. In such embodiments, there may or may not be protruding studs, ribs, or other structures from either of the bodies. In the context of such alternative embodiments, exemplary modifications, as used herein, can include, but are not limited to, etched, molded, grooved, notched, and textured surfaces. For example, referring to the embodiment illustrated in FIG. 2, an expanded, cross-sectional view of the interface between the first and second bodies shows that the vaporization pathway can comprise a channel 202 formed into the surface of the first body 201. The surface 204 of the cavity in the second body 203 can form a non-leaking seal when the first body is inserted into the second body and/or the surfaces mate.

In instances where no protrusions exist, the first body can be secured into the second body using, for example, a bolted flange with gasket or o-ring seal. Alternatively, it can be sealed using a compression fitting. Furthermore, the first body and the cavity in the second body can be conically tapered or substantially spherically shaped (e.g., a ball-and-socket). Further still, the surfaces of the first body and the cavity in the second body can be textured (e.g., ground) to facilitate the union between the two bodies. Referring to the embodiment illustrated in FIG. 3, the mating surfaces 304 of the first body 301 and the second body 302 can be textured. Exemplary texturing can include, but is not limited to, a porous layer of sintered metal particles, a layer of metal felt, or a fine pattern of grooves which when the two surfaces are brough together provide the vaporization pathway. As shown also in FIG. 3, retaining clips 303 can optionally be used to further secure the first body in the second body. The retaining clip is the flat piece that is acting as a collar on piece 301. The two pegs are bolts holding the collar in place. The seal in this case would be via an o-ring near the top of the piece 301 which would be compressed as piece 301 is inserted. Alternatively, referring to the embodiment illustrated in FIG. 4, relative to the depth of insertion of the first body 401 into the second body 403, a short segment of screw threads 402 can be used to secure the two bodies together, wherein the segment of screw threads can be separate from the vaporization pathway 404. Still other techniques exist for securing two bodies together, as described elsewhere herein and as might be known in the art, which techniques are encompassed by the scope of the present invention.

In the embodiments described herein, a heater can be employed for heat in addition to the thermal conductor. The heater can be particularly useful during startup or during times of operational instability. The heater can be embedded within the first body or within the second body. For example, referring to the embodiment illustrated in FIG. 5, an electrical cartridge heater 501 can be emplaced within a cavity in the first body 502. Alternatively, referring to the embodiment illustrated in FIG. 6, a resistive element 601 can be embedded within the second body 602. In another variation, the heater can simply surround the liquid vaporizer and/or the vaporization pathway. For example, heating strips and/or the path of a heat exchanger can wrap around the second body.

Some embodiments of the liquid fuel vaporizer and burner can comprise a vaporization pathway, as described elsewhere herein, that comprises a channel formed between two mated surfaces. The surfaces can be separated for cleaning, for maintenance, and for other unforeseen purposes. In a specific embodiment, the vaporization channel comprises a channel formed between the screw threads of a screw and the mating threads of a mated surface, wherein the screw threads, the mating threads, or both have been modified to provide the channel.

As described elsewhere herein, the temperature of the vaporization pathway can be actively controlled through the thermal conductor, the heater, or both. In one embodiment, the combustion chamber is in thermal communication with the liquid vaporizer, and at least a portion of the heat for vaporization is transferred from the combustion chamber. Heat transfer from the combustion chamber can be conductive through the thermal conductor. The use of heat from the combustion chamber can reduce or eliminate the heating load on the heater. Adjustments to the insertion depth of the thermal conductor can be substantially responsible for active control of the vaporization pathway temperature.

Furthermore, heat transfer can be convective and/or radiative. Embodiments, wherein the heater comprises a heat exchanger, can utilize, at least in part, heat from the combustion chamber as a heat source in a controlled scheme. For example, a heat exchanger can utilize recirculated combustion gas in a controlled scheme from the combustion chamber. This is in addition to the conductive heat transfer through the thermal conductor.

In some embodiments, heat from the combustion chamber can also be used to preheat oxidant gas flowing to the combustion chamber, thereby improving the peak combustion temperature. For example, the oxidant gas can be flowed over at least a portion of the exterior of the combustion chamber. Alternatively, a heat exchanger utilizing combustion gases as a heat source can be used to preheat the oxidant gas.

In other embodiments, a flow distribution insert providing flow distribution of oxidant gas flowing to the combustion chamber can be utilized. The insert can be located in a flow path of the oxidant gas upstream from the combustion chamber (i.e., as the oxidant gas flows to the combustion chamber). The flow distribution insert can be thermally conductive and can have a large surface area for enhanced heat transfer to the oxidant gases. An exemplary flow distribution insert can comprise a thermally conductive foam that is in thermal communication with the combustion chamber and the oxidant gas.

Figure 7:
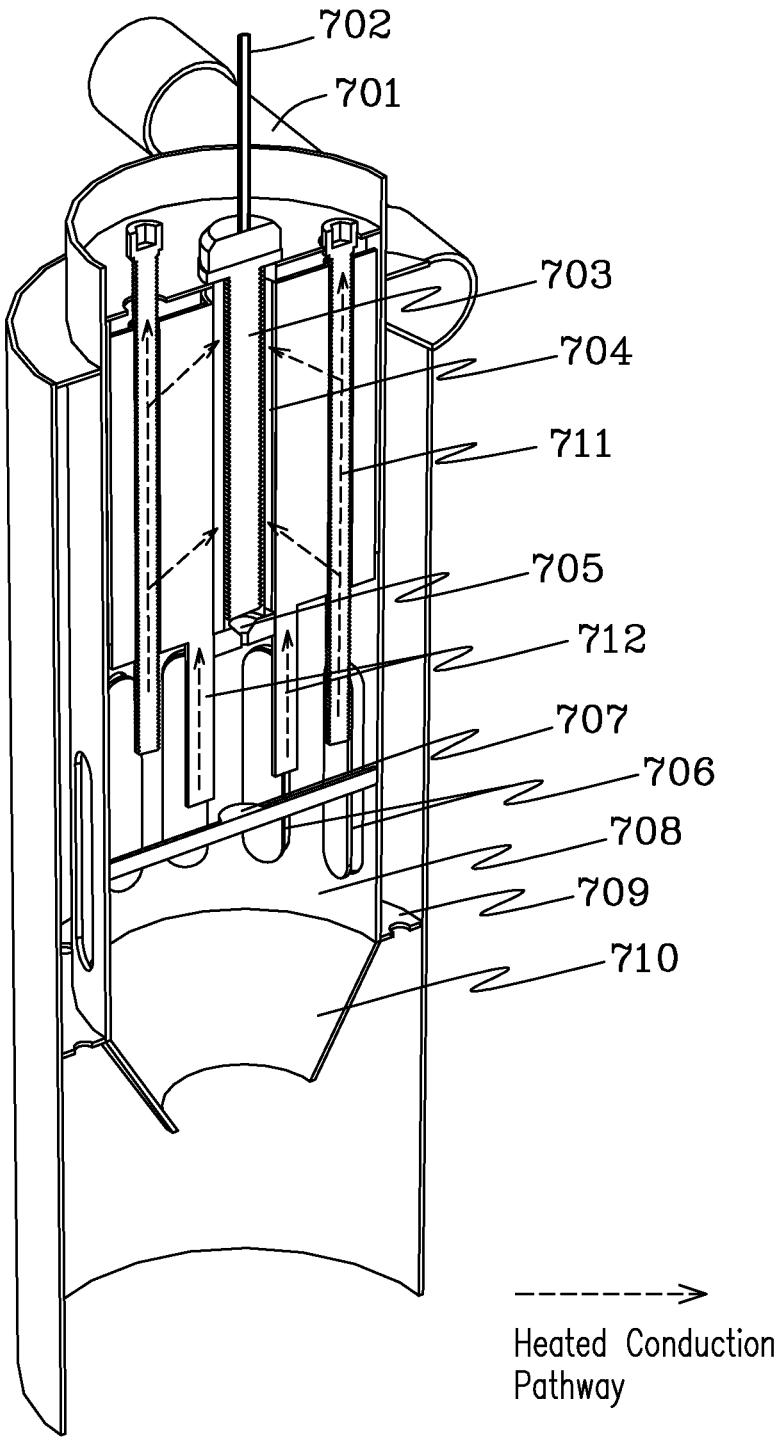
FIG. 7 is an illustration of one embodiment of a liquid fuel vaporizer and combustion chamber having a thermal conductor.

Referring to FIG. 7, the schematic diagram depicts the cross-section of a liquid fuel vaporizer and a combustion chamber having a thermal conductor. The vaporizer comprises a fuel inlet 702 providing fuel to a vaporization channel formed between a vaporizer center screw 703 and a vaporizer pressure shell 704. Vaporized fuel exits the vaporizer through a nozzle 705 towards the combustion chamber 708. Air is provided to the combustion chamber through the air inlets 701, 706 and/or is excessed through the air bypass plate 709. Combustion exhaust exits through the appropriate outlet 710. The thermal conductors, in the instant example, comprise movable members 711 having adjustable insertion depths. Heat from the combustion chamber is transported conductively through the movable members, which can positioned at various insertion depths relative to the combustion chamber. The movable members can have a relatively large diameter if constructed of a high temperature nickel-based alloy with low thermal conductivity or can have a relatively small diameter if made from a high thermal conductivity material such as copper. In one variation, the movable members comprise a high temperature alloy with a copper core. FIG. 7 further depicts stationary members 712 that can provide a baseline heat supply from the combustion chamber to the vaporizer. An impaction plate can be detached from the stationary members, or as shown in FIG. 8, the stationary members can support the impaction plate in the combustion chamber.

Figure 8:
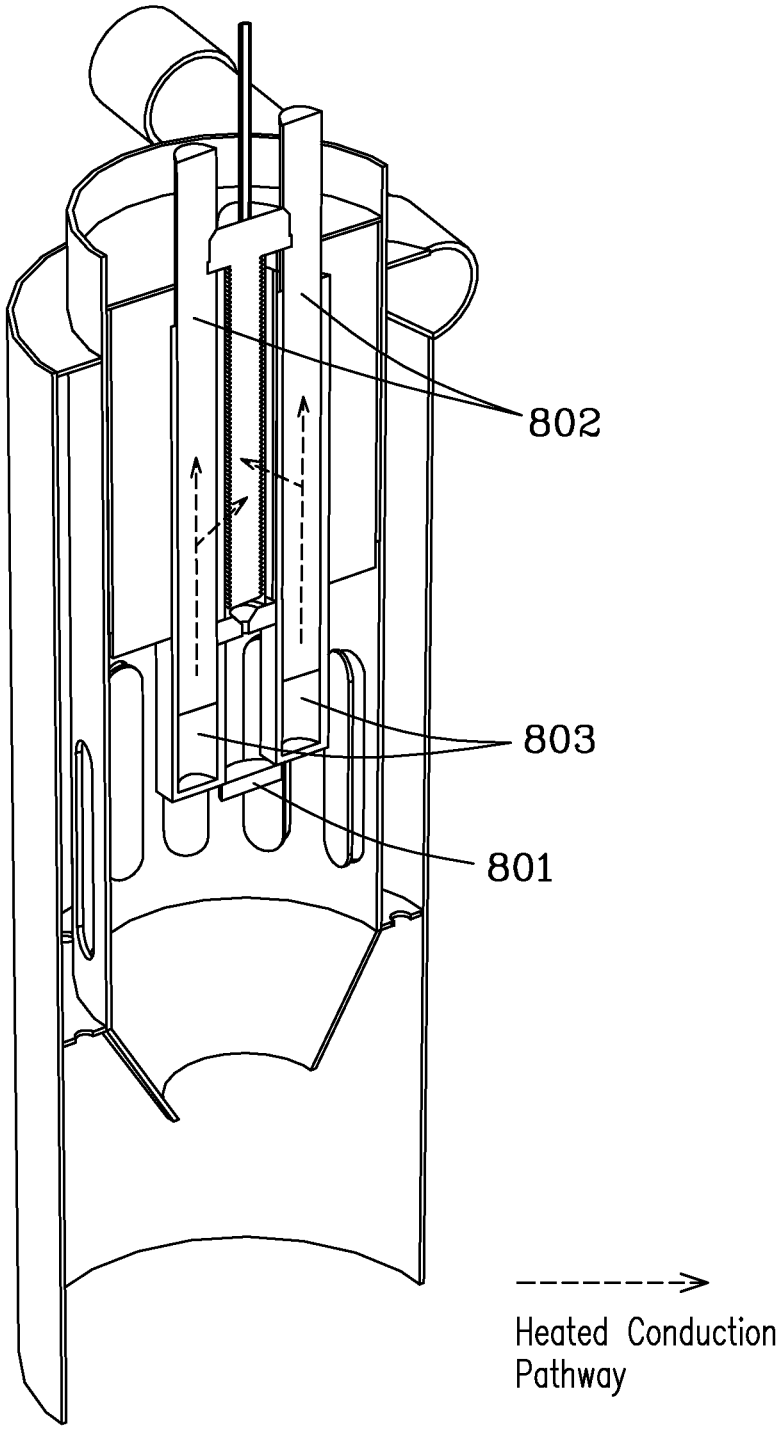
FIG. 8 is an illustration of another embodiment of a liquid fuel vaporizer and combustion chamber having a thermal conductor.

In the embodiment shown in FIG. 8, the movable members 802 are inserted within the stationary members 803, which support the impaction plate 801. The rate of conductive heat transfer can be engineered through material selection and/or design parameters. For example, increasing the relative size of the movable members can compensate for movable members having lower thermal conductivities. Furthermore, as described elsewhere herein, the stationary members can provide a baseline amount of heat transfer reducing the load on the movable members. Further still, additional heat can be transferred to the vaporizer by radiation and/or convection. The conductive heat transfer is shown by a dashed line in FIGS. 7 through 10.

Figure 9:
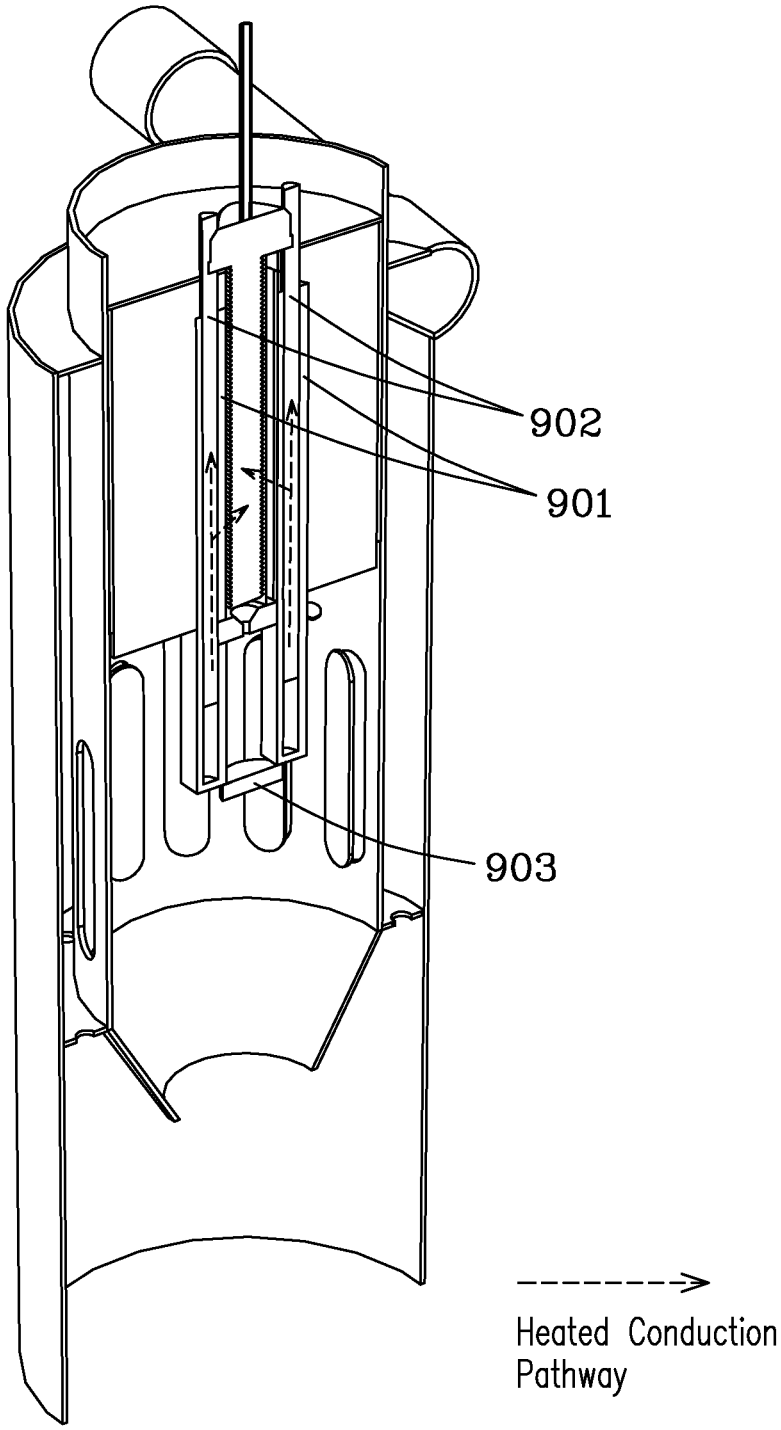
FIG. 9 is an illustration of yet another embodiment of a liquid fuel vaporizer and combustion chamber having a thermal conductor.

In another embodiment, referring to FIG. 9, stationary members 901 configured as hollow supports are attached to the impaction plate 903. The movable members 902, comprising a high thermal conductivity material, are placed inside the support rods. The rate of conductive heat transfer can be adjusted by altering the insertion depth of the movable members.

Figure 10:
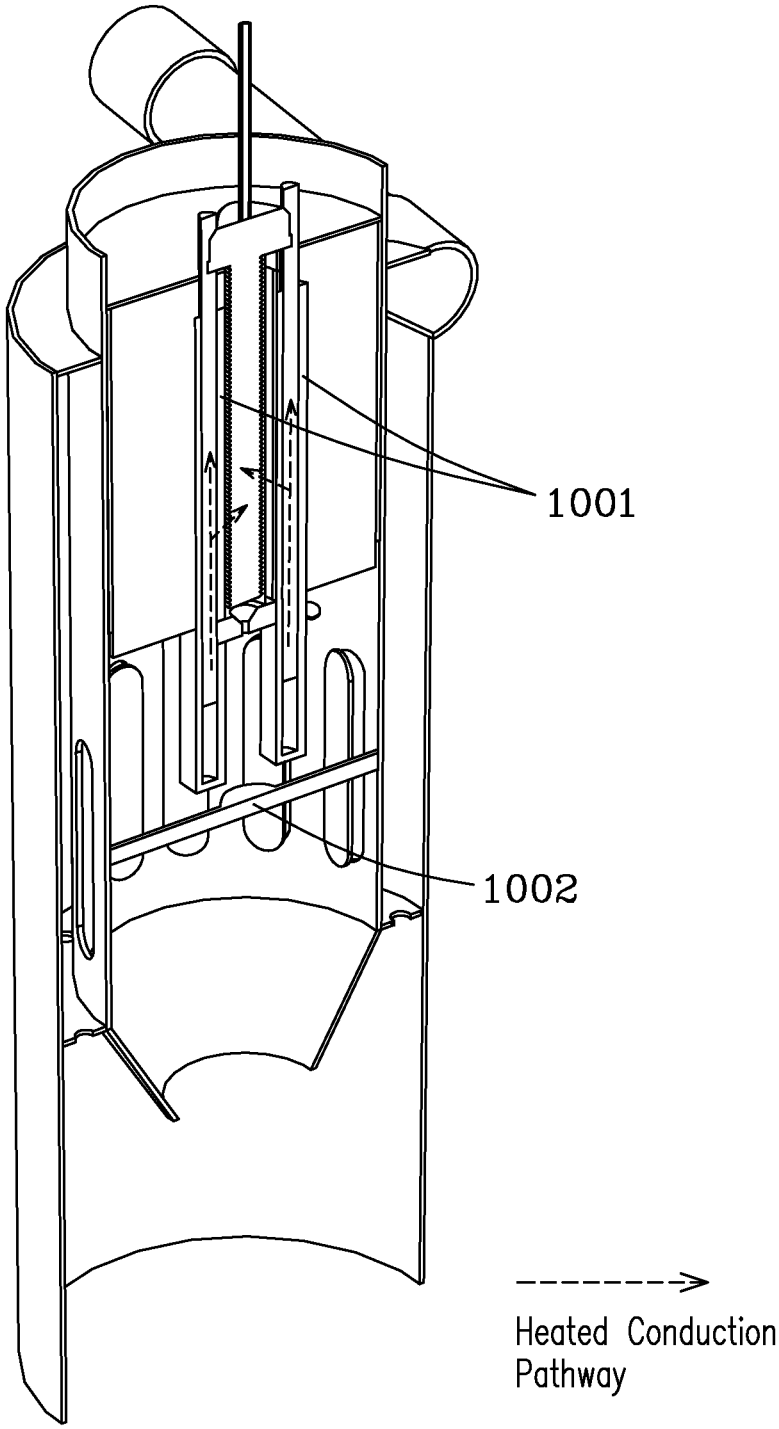
FIG. 10 is an illustration of still another embodiment of a liquid fuel vaporizer and combustion chamber having a thermal conductor.

In yet another embodiment, referring to FIG. 10, the stationary members, 1001 do not support the impaction plate 1002, which is separately attached in the combustion chamber.

The design and the active temperature control of the vaporization pathway enables the embodiments of liquid fuel vaporizer and burners described herein to operate for long periods of time over a wide operating range with minimal deposit formation. Accordingly, in some embodiments, active control of the temperature of the vaporization pathway occurs over an operating range turndown ratio of up to at least 5 to 1, and preferably of up to at least 10 to 1. Furthermore, at least some of the embodiments of liquid fuel vaporizer and burners described herein can deliver heat at a substantially steady rate for at least 30 minutes. Should deposits form in spite of the design and/or the active temperature control, embodiments having separable bodies forming the vaporization pathway can expose the vaporization pathway for cleaning and maintenance.

While a number of embodiments of the present invention have been shown and described, it will be apparent to those skilled in the art that many changes and modifications may be made without departing from the invention in its broader aspects. The appended claims, therefore, are intended to cover all such changes and modifications as they fall within the true spirit and scope of the invention.

We claim:

1. An apparatus comprising a liquid fuel vaporizer and a combustion chamber for combusting vaporized liquid fuel, the apparatus characterized by:

A thermal conductor that conducts heat from the combustion chamber to the vaporizer and comprises a thermally conductive movable member positioned at an insertion depth within the combustion chamber, the insertion depth corresponding to a rate of heat conduction from the combustion chamber to the vaporizer, wherein a support member proximal to the vaporizer forms a longitudinal cavity in which the thermally conductive movable member is supported at said insertion depth within the combustion chamber.

2. The apparatus of claim 1, wherein the thermally conductive movable member comprises copper.

3. The apparatus of claim 1, further comprising an actuator controlling the insertion depth of the thermally conductive movable member.

4. The apparatus of claim 1, wherein the liquid fuel has a boiling range greater than or equal to that of 300° C.

5. The apparatus of claim 1, wherein the vaporizer has an operating temperature range between 300° C. and 400° C.

6. The apparatus of claim 1, wherein the vaporizer comprises:

a first body having a cross sectional shape and dimensions substantially equal to the cross sectional shape and dimensions of a cavity in a second body, thereby allowing the first body to be non-permanently inserted into the second body, wherein the outer surface of the first body, the inner surface forming the cavity in the second body, or both is modified to create a vaporization pathway between the first and second bodies when the surfaces mate;

a vaporization pathway inlet for fluid comprising a liquid; and a vaporization pathway outlet for fluid comprising primarily vapor.

7. The apparatus as recited in claim 6, wherein the vaporization pathway comprises a channel along the outer surface of the first body, along the inner surface forming the cavity in the second body, or both.

8. The apparatus as recited in claim 6, wherein the vaporization pathway is curved to increase the vaporization pathway for heat transfer.

9. The apparatus as recited in claim 6, wherein the first body comprises a screw having screw threads and the inner surface forming the cavity in the second body has cavity threads corresponding to the screw threads, and wherein the screw threads, the cavity threads, or both are modified to provide a channel for fluid flow, wherein the channel composes the vaporization pathway.

10. The apparatus as recited in claim 9, wherein the modified threads comprise threads that have been truncated, notched, removed, or combinations thereof.

11. The apparatus of claim 1, further comprising a stationary member protruding from the support member into the combustion chamber and extending the longitudinal cavity inside of which the thermally conductive movable member is inserted, the thermal conductor having a composite thermal conductivity based on the insertion depth of the movable member, the movable member thermal conductivity, and the stationary member thermal conductivity.

12. The apparatus of claim 11, wherein the movable member thermal conductivity is greater than or substantially equal to the stationary member thermal conductivity.

13. The apparatus of claim 11, wherein the stationary member attaches to, and supports, at least in part, an impaction plate within the combustion chamber.

14. The apparatus of claim 13, wherein the stationary member is arranged as one or more posts attached to the impaction plate.

15. The apparatus of claim 14, wherein the thermally conductive movable member comprises a rod placed in one or more of the posts.

16. The apparatus of claim 13 wherein the stationary member comprises a corrosion resistant material.

17. The apparatus of claim 16, wherein the stationary member comprises a nickel-chromium-based alloy.

* * * * *